US005650111A

United States Patent [19]

Gasland

[11] Patent Number: 5,650,111

[45] Date of Patent: Jul. 22, 1997

[54] PROCESS OF MAKING CELLULOSE PRODUCTS FROM STRAW

[76] Inventor: Stein Gasland, Dreyersvej 29, 2960 Rungsted Kyst, Denmark

[21] Appl. No.: 500,889

[22] PCT Filed: Jan. 27, 1994

[86] PCT No.: PCT/DK94/00046

§ 371 Date: Sep. 12, 1995

§ 102(e) Date: Sep. 12, 1995

[87] PCT Pub. No.: WO94/18388

PCT Pub. Date: Aug. 18, 1994

[30] Foreign Application Priority Data

Feb. 2, 1993 [DK] Denmark ..... 0118/93

[51] Int. Cl.[6] ..... B29C 43/24; B29C 45/00; B29C 47/00

[52] U.S. Cl. ..... 264/175; 106/164.01; 106/205.01; 162/90; 162/97; 162/218; 264/211; 264/211.11; 264/328.1

[58] Field of Search ..... 264/175, 211, 264/211.11, 328.1; 162/90, 97, 218; 106/164.01, 205.01

[56] References Cited

U.S. PATENT DOCUMENTS

| | | | |
|---|---|---|---|
| 1,718,011 | 6/1929 | Vogt | 162/11 |
| 3,892,586 | 7/1975 | Vladar et al. | 106/164.42 |
| 4,377,440 | 3/1983 | Gasland | 162/101 |

FOREIGN PATENT DOCUMENTS

| | | |
|---|---|---|
| 1051109 | 2/1959 | Germany . |

*Primary Examiner*—Leo B. Tentoni
*Attorney, Agent, or Firm*—Roylance, Abrams, Berdo & Goodman, L.L.P.

[57] ABSTRACT

A dispersion of cellulose based fibers in straw is produced by the aid of alkali and strong mechanical agitation. This solubilizes the pentosane in the straw, and turns the mixture into a high viscosity paste, so that the forces from the agitation tear the individual straws apart and disperses the fibers. In this way the fibers can be dispersed at solid content up to 85% compared to only 8% by traditional methods. The treatment results in a molding paste, which can be used directly for plastic forming of cellulose based fiber products after neutralizing.

23 Claims, No Drawings

PROCESS OF MAKING CELLULOSE PRODUCTS FROM STRAW

The invention concerns dispersion of the cellulose based fibres in straw with alkali during strong mechanical action and at solid content up to 85%. This action leads to a moulding composition, which is suitable for plastic forming of cellulose containing fibre products.

The most valuable part of straw is cellulose fibre. This may be used for paper production, but it makes up only a bit more than ⅓ of the solid in straw. Almost half the solid is extractable with alkali. By such extraction carbohydrates with chains shorter than cellulose are made soluble, and in the paper industry that is called hemicellulose. It is mainly composed of pentosanes and it acts as a hydrocolloid.

Before straw can be used for paper production it is pulped in water after addition of alkali. The highest concentrations which are used in the beginning of the pulping process is 40% dry straw plus 8% alkali. At the end of the pulping the concentration is much lower, because the heating is done by direct supply of steam. The alkali usually is caustic soda, lime or mixtures thereof.

The pulping solubilizes most of the alkali extractable material. That softens the straw, so that the non-extractable cellulose fibres can be liberated by a succeeding milling operation. The concentration used for this dispersion of the fibres is typically a few percent and in special cases up to 8%.

One of the advantages of the invention is that it solves the problem of the low concentration by a new process for dispersion of the cellulose based fibres in straw with alkali in water. The new process is characterised in that the liberation of the fibres from each other is carded out under strong mechanical action at solid content up to 85%. In so doing, the suspension is transformed into a homogeneous paste.

Even though the inventor does not want to be committed to any particular theory to explain the mechanism which is behind the invention, it is supposed that the plasticity is given by the dissolved pentosane. It acts as a hydrocolloid. When the amount of water is low, the pentosane binds the water, and the mixture gets a high viscosity as a paste. In this way a self increasing effect is obtained, because the high viscosity conveys the movement of the agitator out into the paste to the individual straws and further into the individual fibres to tear them apart, by which mean still more pentosane is being dissolved. There is a great chemical affinity between the hydroxyl groups on the fibres and on the pentosane. This causes the pentosane to coat the fibres and prevents them from reassociation when the movement of the agitator stops.

If faster formation of paste is wished, than possible by the natural content of the pentosane in straw, extra hydrocolloid may be added, f. inst. starch, so that the agitator gets into attack with the fibres earlier.

The treatment of the straw may be performed in a particularly strong mixer, preferably in a kneading machine which can be heated.

The invention may be used as a introductory production step for traditional paper making, in such a way that the paste resulting from the liberation of the fibres is diluted with great amounts of water, and the obtained suspension is then dewatered on a water permeable wire, so that the fibres are retained on the wire. However, the large amount of pentosanes makes straw unsuited for traditional paper production. The pentosane causes three problems:

1. After the pulping, washing and filtering are carried out - before or after the milling. In so doing the greatest part of the extractable material and the surplus of alkali is lost. This amounts to about half of the solids, and is a great economical burden.
2. Discharge of this large amount of material dissolved in the effluent water is a great environmental problem.
3. Fibres from straw contain hemicellulose and shorter fibres than the cellulose or ground wood, which is normally being used for production of paper, and this reduces the speed at which the paper can be formed by dewatering on the water permeable wire.

The high content of pentosane in straw is responsible for the fact that it has not yet been possible to find a commercial viable usage of this great by-product from agriculture. Therefore straw is usually burnt.

It is another advantage of the invention that the paste from the dispersion may be used directly for plastic forming by new methods for cellulose based fibre products such as extrusion, injection moulding, coating, pressing or rolling.

In this way the pentosane has changed from being a production problem to becoming a production aid. First, it is an aid by the dispersion of the fibres, as described above, and thereafter aid for the plastic forming. A good moulding paste shall not only have perfectly dispersed fibres. If the paste is to be used for extrusion or injection moulding, it is also necessary that the paste contains so much hydrocolloid that the water is completely bound, or stated more precisely so that free water cannot be seen on the surface of the moulding paste, just after it has been pressed out of an extruder nozzle. If free (shining) water can be seen on the thread, which is coming out of the nozzle, experience has shown that only short time elapses until the nozzle becomes clogged by fibres, which have lost water and hydrocolloid. Complete binding of water is also an advantage by the dispersion of the fibres.

The dispersion of the fibres or in other words the preparation of the moulding composition may be carded out at different temperatures. High temperature is particularly interesting. In this way the fibres may be liberated at still higher solid content than at normal temperatures, and solubilization of the pentosane is faster. The upper limit for the temperature is about 250° C., at which temperature the pentosane starts to decompose.

It has been proven that the moulding paste stands the high pressures which appear during the kneading and also in the extruders used for forming the moulding paste.

Production of cellulose containing fibre products may be simplified by performing the dispersion of the fibres and the forming of the fibre products as a continuous process, f. inst. in such a way that the paste is first kneaded at high temperature and high pH in the beginning of a cook-extruder, and then—possibly after cooling and neutralising the pH—to form in the nozzle of an extruder or by pressing into the mould of an injection moulding machine.

The types of straw which are most suited for the invention are from barley, wheat, oat, rye, rice or other cereals.

Different types of alkali may be used, but practise has shown that caustic soda (NaOH), lime ($Ca(OH)_2$) and quicklime (CaO) are most interesting. Caustic soda is most efficient. The two types of time, however, have the advantages of being cheaper and to result in end products with better resistance to water.

Both the dispersion of the fibres and the forming of the fibre products are done easiest at modest solid content of about 50%. However, after the forming there is a drying, and this is more difficult to carry out with lower solid contents. It is therefore usually advantageous to perform the dispersion at a lower solid content than the forming. Solubilizing of pentosane and dispersion of the fibres may therefore be started with hot kneading at 40% solid. During this treatment water evaporates from the kneading machine, and the fibres become perfectly dispersed f. inst. when the solid content has reached 55%. The paste may then be kneaded further with heat supply until solid content reaches 80%. The forming then needs a bit higher pressure at 80% than if the kneading had been terminated at 55%, but this disadvantage, and the extra operation of evaporating up to 80% solid content, is more than compensated for by a much easier drying.

Pentosane has a tendency to make the paste sticky, and this stickiness may cause operational problems. The stickiness may be reduced by addition of additives such as wax and latex-emulsions. The stickiness may also be reduced by increasing the solid content, f. inst. as described in the previous paragraph. In that way the paste gets less adhesion to other parts and more cohesion in itself. Addition of wax with correctly chosen melting point may also increase the speed of forming, as the paste cures faster by cooling f. inst. in the mould of an injection moulding machine.

It is usually an advantage to add acid after the dispersion, to neutralise the surplus of alkali from the pentosane solubilization.

Some experiments shall be described below. They were done to establish the conditions needed to solubilize the pentosane and transform the mixture into an extrudable paste.

As an introductory operation before all experiments, a premix was first made from 100 g air dried straw from barley moistened with 200 ml water. Barley was chosen as raw material, because it is more difficult to pulp than wheat, so that when the trials succeeded with barley they would certainly also succeed with wheat. To this premix, the chemicals were then added, as described below.

The experiments were performed at two levels: First a rough sorting was done in an ordinary mix master for domestic use with a mixing claw of the make Braun KM 32. Those mixes, which by that method demonstrated good tendency for being pasteable, were afterwards more thoroughly investigated in a laboratory high shear mixer of the make Brabender Plast-Corder PL 2000. This apparatus gives a very intensive kneading, and its content may be heated. The high shear mixer is designed to simulate the mixing action which takes place inside the extruders, which are being used in the plastic industry. The mixer consists of two thick paddles with propeller shape and which rotate with very small distance to each other and to the inner walls of the mixing chamber, pretty much the same way as in a gear pump.

The pretrials in the domestic mixer were done in such a way that the sample was alternately heated to 95° C. in a domestic micro wave oven and kneaded in the mix master. This treatment was repeated four times in rapid succession. Afterwards the straw was investigated to see to which extent it had softened. Such softening was always accompanied with a development of a paste like substance on the surface of the straws. The pretrials are ranked below according to increasing amount of pasting.

Mix 1 with addition of 8 ml 96% sulphuric acid. No paste developed, and the straw remained stiff.

Mix 2 with addition of 11 ml 65% nitric acid. No paste developed, and the straw remained stiff.

Mix 3 with addition of 30 g lime. There was a slight development of paste, and the straw remained almost as stiff as it was before the treatment.

Mix 4 was as mix 3, with the modification that the moistening of the straw had been done with 200 ml 25% ammonia instead of 200 ml straight water. Paste development and stiffness were as mix 3, i.e. the ammonia gave no improvement.

Mix 5 with addition of 15 g caustic soda. The mixture mined brown, and there was a strong paste development. The straw softened, but the mechanical action was not strong enough to obtain a homogeneous paste.

Consequently, the pretrials showed caustic and lime to be most interesting. The more thorough investigation was therefore performed in the Brabender mixer with caustic soda, lime and mixtures thereof.

At the same time while the Brabender mixer tore the straw apart, the volume of the mixture dropped to less than ⅕ original size, because the hollow space inside each straw collapsed. It therefore became necessary at the beginning of each trial to compress the mixture firmly and to refill when the volume dropped. By failure of doing so, the mixer's content separated in two zones: An inner one around the paddles with well dispersed paste and an outer stagnant zone adjacent to the wall of the mixing chamber containing intact straw. The results reported below were obtained with efficient filling and agitation of the entire content of the mixer.

The speed of rotation of the Brabender mixer was adjusted to 75 rpm, and the temperature to 115° C. The torque for the different mixtures was automatically recorded on a diagram.

Mix 3. The torque rose quickly to 4 Nm. Free water could be observed in the mixer at those places where the mixture became exposed to the highest pressure. It appeared that lime does not solubilize pentosane fast enough to completely bind the water. The torque remained at about 4 Nm until 7 minutes from commencing the kneading. Then, it suddenly increased because of the water which had evaporated. The mixer was stopped, and the sample taken out. The mixer had tom the straws into pieces, but had not succeeded in liberation of the individual fibres. The sample was not homogeneous.

Mix 6 with addition of 22 g quick lime and 8 g extra water, which ought to be identical to mix 3. This was proven to be the case, as the course of events in the mixer with the two types of lime was also identical.

Mix 7 with addition of 20 g lime and 5 g caustic soda. The torque first became 4 Nm. It could be observed that the mixture gradually became more homogeneous. After 7½ minute so much water had evaporated that the torque rose quickly. The mixer was then stopped, and the sample taken out. It was not homogeneous, and it's solid content was 64%.

Mix 8 with addition of 10 g lime and 10 g caustic soda. Also this time the torque first became 4 Nm, but after a few minutes it decreased to 1 Nm, and at the same time it could be observed that the straw was tom apart, and the inhomogeneous mixture was transformed to a homogeneous paste containing the individual liberated cellulose fibres. After 7 minutes of total kneading, the torque started to increase again. After 8 minutes it had reached 15 Nm, which by experience with plastics at 75 rpm is close to the highest torque which can be handled. That torque was reached after 8 minutes, and the sample was then taken out. After pressing into a thin sheet, it proved to be perfectly homogeneous without occurrence of any fibre bundles. Solid content was 71%.

Mix 5. The torque became 4 Nm in the beginning, as for earlier experiments. After a few minutes is decreased to almost zero, and the mixture simultaneously tamed into a smooth homogeneous paste. After 9 minutes the torque had reached 15 Nm, and the sample was taken out. Investigation of a thin sheet showed the sample to contain individual cellulose fibres in a perfect homogeneous mixture. Solid content was measured to 76%.

This last trial was repeated in such a way that 96% sulphuric acid for neutralisation was added into the mixer, when the torque was about to pass 10 Nm. The needed amount of sulphuric acid for reducing pH to 9 was 8 ml, relative to those amounts which were given at the beginning of this experimental description.

I claim:

1. A method of making a molded product containing fibers from straw, comprising the steps of:

mixing straw, water and alkali to form a mixture having a solid content of about 40–85%;

kneading said mixture to solubilize pentosanes in said straw and to produce a substantially homogenous molding paste, said mixture containing an effective amount of alkali to solubilize substantially all of the pentosanes in said straw to produce said paste; and molding and drying said paste to form a molded product.

2. A method of claim 1, further comprising adding a hydrocolloid to said mixture to increase a rate of paste formation and support complete binding of water in said mixture.

3. A method according to claim 1, wherein said kneading step is carried out at a temperature of up to 250° C.

4. A method according to claim 1, wherein said kneading step is carried out at an elevated pressure in an extruder under sufficient shear to separate cellulose fibers from said straw.

5. A method according to claim 1, wherein said method is a continuous method and the kneading step is carried out in an extruder, and said molding step comprises extruding said paste through a nozzle coupled to said extruder.

6. A method according to claim 1, wherein said straw is a byproduct from agricultural production of food or feed.

7. A method according to claim 1, wherein said alkali is caustic soda, lime, quicklime or mixtures thereof.

8. A method according to claim 1, further comprising evaporating water from said mixture to obtain a water content of at least 15%.

9. A method according to claim 1, further comprising adding a wax or latex emulsion to said mixture to improve moldability.

10. A method according to claim 1, further comprising the step of adding an acid to said paste to neutralize alkali not consumed during said solubilization of pentosanes and said paste formation.

11. A method according to claim 1, wherein said molding step comprises extrusion, injection molding, coating, pressing, or rolling.

12. A method according to claim 1, wherein said straw is selected from the group consisting of barley, wheat, oat, rye and rice.

13. A method of producing a cellulose-containing molding composition, comprising the steps of:

forming a mixture of straw, water and alkali, said mixture having an alkali content sufficient to solubilize substantially all pentosanes in said straw; and kneading said mixture in a mixing device at sufficient shear and torque to separate fibers of said straw, solubilize said pentosanes to produce a paste having a solid content of about 40–85%.

14. The method of claim 13, wherein said kneading step completely binds water in said mixture.

15. The method of claim 13, wherein said kneading step increases a viscosity of said mixture.

16. A method according to claim 13, wherein said mixing device is a high shear mixer.

17. A method according to claim 13, wherein said mixing device is an extruder.

18. A method according to claim 13, wherein said paste has substantially no unbound water.

19. A molding paste composition comprising cellulose fiber, completely solubilized pentosanes and water in an amount of 15 to 60%, said composition being produced by the steps of:

forming a mixture of straw, water and alkali, said mixture having an alkali content sufficient to solubilize substantially all of the pentosanes in said straw; and kneading said mixture in a mixing device at sufficient shear, torque, temperature and pressure to completely solubilize substantially all of said pentosanes for binding water, and separate cellulose fibers from said straw.

20. The composition of claim 19, wherein said paste has a solids content of about 45% to 85%.

21. The composition of claim 19, wherein said mixture device is selected from the group consisting of an extruder or a high shear mixer.

22. The composition of claim 19, wherein said kneading is at an elevated pressure and temperature.

23. The composition of claim 19, further comprising a hydrocolloid to completely bind water in said paste.

* * * * *